US011191311B2

(12) United States Patent
Hammer et al.

(10) Patent No.: US 11,191,311 B2
(45) Date of Patent: Dec. 7, 2021

(54) HAND COVERING HAVING A RETAINER ELEMENT

(71) Applicant: Wm. T. Burnett IP, LLC, Baltimore, MD (US)

(72) Inventors: Bryan Hammer, Catonsville, MD (US); Michael F. O'Brien, Brooklyn, NY (US)

(73) Assignee: W.m. T. Burnett IP, LLC, Baltimore, MD (US)

( * ) Notice: Subject to any disclaimer, the term of this patent is extended or adjusted under 35 U.S.C. 154(b) by 240 days.

(21) Appl. No.: 16/218,598

(22) Filed: Dec. 13, 2018

(65) Prior Publication Data

US 2019/0192955 A1 Jun. 27, 2019

Related U.S. Application Data

(60) Provisional application No. 62/609,483, filed on Dec. 22, 2017.

(51) Int. Cl.
*A41D 19/00* (2006.01)
*A41D 13/08* (2006.01)

(52) U.S. Cl.
CPC ..... *A41D 19/0041* (2013.01); *A41D 13/081* (2013.01); *A41D 19/0048* (2013.01); *A41D 19/0093* (2013.01); *A41D 2300/32* (2013.01); *A41D 2600/10* (2013.01)

(58) Field of Classification Search
CPC .. A41D 13/081; A41D 13/088; A41D 13/084; A41D 13/082; A41D 19/0041; A41D 19/0048; A41D 19/0034; A41D 19/0044; A41D 19/0089; A41D 19/0093; A41D 2300/32; A41D 27/22
USPC ..... 2/16, 161.4, 162, 170, 910, 917
See application file for complete search history.

(56) References Cited

U.S. PATENT DOCUMENTS 1,351,311 A * 8/1920 Virneburg ..... A47K 7/03 401/8
2,323,136 A 6/1943 Johanson
2,445,987 A * 7/1948 Ashman ..... A47K 7/02 2/158
2,518,424 A * 8/1950 Kaas ..... A41D 19/0055 2/158
2,743,453 A 5/1956 Singer
(Continued)

FOREIGN PATENT DOCUMENTS

GB 154407 A * 12/1920 ..... A41D 19/0041

*Primary Examiner* — Jameson D Collier
(74) *Attorney, Agent, or Firm* — Plumsea Law Group, LLC

(57) ABSTRACT

Embodiments provide a hand covering, such as a glove or mitten, with a retainer for holding the hand covering in a retaining configuration when not being worn covering the hand of a user. The hand covering may include a central hand portion, a finger receiving portion extending from the central hand portion, and a strap. The hand covering may extend generally in a longitudinal direction from a proximal side at the central hand portion to a distal side at the finger receiving portion. The central hand portion may define at the proximal side a cavity configured to receive a hand. The strap may be attached to an inside face of the central hand portion and extend generally lateral to the longitudinal direction. The strap may be separable from the inside face in between a first attached end and a second attached end to define a passageway configured to receive a hand.

18 Claims, 19 Drawing Sheets

(56) References Cited

U.S. PATENT DOCUMENTS

| | | | | |
|---|---|---|---|---|
| 5,444,874 | A | 8/1995 | Samelian et al. | |
| 7,370,373 | B2 | 5/2008 | Kohler | |
| 7,636,951 | B2 | 12/2009 | Morrow et al. | |
| 7,774,860 | B2 | 8/2010 | Kohler | |
| 7,900,275 | B2 | 3/2011 | Morrow et al. | |
| 8,181,275 | B2 | 5/2012 | Saturnio | |
| 9,802,104 | B2 | 10/2017 | Cox | |
| 9,839,831 | B2 | 12/2017 | Brown et al. | |
| 2008/0083048 | A1* | 4/2008 | Morrow | A63B 71/143 2/16 |
| 2011/0265243 | A1 | 11/2011 | Kaplan | |
| 2013/0283498 | A1* | 10/2013 | Hewitt | A63B 71/141 2/161.1 |

* cited by examiner

HAND COVERING HAVING A RETAINER ELEMENT

CROSS-REFERENCE TO RELATED APPLICATION

This application claims the benefit of U.S. Provisional Application No. 62/609,483, filed Dec. 22, 2017, which is herein incorporated by reference in its entirety.

BACKGROUND

Field

The present embodiments relate generally to hand coverings, and more particularly, to a glove, mitten, or other hand covering, having a central hand portion with an internal retaining element for holding (e.g., dangling) the hand covering on a user's wrist when the hand covering is not in use covering the hand.

Background

Hand coverings, such as gloves or mittens, are typically separate garments, one for each hand, and apart from other garments such as coats. When not worn on the hands, the hand coverings are typically stored in pockets of a coat or are otherwise set aside. Therefore, when required for an activity, a user may be inconvenienced by the effort and time required to locate, retrieve, and don the hand coverings for each use. This inconvenience may be especially troublesome during participation in activities requiring quick action, such as sport activities. In addition, some hand coverings may be large and bulky and not susceptible to easy storage during periods of non-use. For example, lacrosse gloves and ice hockey gloves are particularly cumbersome to hold and keep track of in between periods of use.

SUMMARY

Embodiments provide a hand covering, such as a glove or mitten, with a retainer element for holding the hand covering in a retaining configuration (e.g., dangling) when not being worn covering the hand of a user.

One aspect provides a hand covering including a central hand portion, a finger receiving portion extending from the central hand portion, and a strap. The hand covering may extend generally in a longitudinal direction from a proximal side at the central hand portion to a distal side at the finger receiving portion. The central hand portion may define at the proximal side a cavity configured to receive a hand. The strap may be attached to an inside face of the central hand portion and may extend generally lateral to the longitudinal direction.

In another aspect, the strap may be elastic.

In another aspect, the strap may have a first end and a second end opposite to the first end. The first end may be attached to a first attachment point on the inside face of the central hand portion and the second end may be attached to a second attachment point on the inside face of the central hand portion. The strap may be separable from the inside face in between the first end and the second end to define a passageway configured for passage of a hand being withdrawn from the central hand portion.

In another aspect, a distance between the first end and the second end of the strap may be substantially equal to a distance between the first attachment point on the inside face and the second attachment point on the inside face.

In another aspect, the passageway may be defined at a dorsal side of the hand covering.

In another aspect, the strap may be disposed adjacent to the proximal side of the hand covering.

In another aspect, the central hand portion may include a cuff portion at the proximal side of the hand covering. The cuff portion may have an inside face configured to face a hand, a wrist, and/or a forearm of a user wearing the hand covering. The strap may be attached to the inside face of the cuff portion.

In another aspect, the cuff portion may have a first end portion and a second end portion opposite to the first end portion. The cuff portion may extend from the first end portion to the second end portion in a direction generally lateral to the longitudinal direction and may be configured to wrap around the hand, the wrist, and/or the forearm of the user wearing the hand covering. The first end portion may include a first fastener portion and the second end portion may include a second fastener portion. The first fastener portion may fasten to the second fastener portion to hold the cuff portion around the wrist of the user wearing the hand covering.

In another aspect, the cuff portion may include an elastic portion that allows the cuff portion to increase and decrease in length around the hand, the wrist, and/or the forearm of the user wearing the hand covering.

In another aspect, the first fastener portion and the second fastener portion may comprise a hook and loop fastener.

In another aspect, when the hand covering is worn by the user with the hand of the user in the cavity, the strap may be configured to remain adjacent to the inside face of the cuff portion between the inside face of the cuff portion and the hand, the wrist, and/or the forearm of the user.

In another aspect, when the hand covering is in a retaining configuration with the hand of the user out of the cavity, the strap may be configured to hold the hand, the wrist, and/or the forearm of the user between the strap and the inside face of the cuff portion.

In another aspect, the cuff portion may include a cuff panel, and the strap may have a width at least one-quarter a width of the cuff panel.

In another aspect, the strap may have a width at least one-quarter a length of the central hand portion in the longitudinal direction.

In another aspect, the hand covering may be a glove or a mitten.

Another aspect provides a method for using a hand covering. The method may include receiving a hand inside the hand covering, wherein the hand covering includes a central hand portion; a finger receiving portion extending from the central hand portion; wherein the hand covering extends generally in a longitudinal direction from a proximal side at the central hand portion to a distal side at the finger receiving portion, and wherein the central hand portion defines at the proximal side a cavity configured to receive a hand; and a strap attached to an inside face of the central hand portion and extending generally lateral to the longitudinal direction, wherein the strap is disposed between the user and the inside face of the central hand portion. The method may include allowing the user to withdraw the hand from the cavity while passing the hand through a passageway between the strap and the inside face of the central hand portion; and allowing the user to pull the strap over a largest dimension of the hand to a position at approximately a wrist of the user, with the hand outside of the hand covering, and the remaining portions of the hand covering on a side of the wrist opposite to the strap.

In another aspect, the central hand portion may include a releasable cuff portion at the proximal side of the hand covering, the strap may be attached to an inside face of the cuff portion, the cuff portion may include an elastic portion, and the method may further include allowing the user to fasten the cuff portion around the wrist after placing the hand inside the hand covering and before withdrawing the hand; and allowing the user to, while withdrawing the hand and keeping the cuff portion fastened, pull the cuff portion to expand the elastic portion and increase the size of the cuff portion, to allow the hand to withdraw through the cuff portion and through the passageway.

Another aspect provides a hand covering that includes a dorsal portion, a palmar portion, and a strap, and extends generally in a longitudinal direction from a proximal end to a distal end. The dorsal portion and the palmar portion may define a cavity at which to receive a central portion of a hand of a user, and may form an inside face of the cavity. The dorsal portion and/or the palmar portion may define an opening at the proximal end, through which to receive passage of the hand. The strap may be attached to the inside face and may extend generally lateral to the longitudinal direction from a first attachment point to a second attachment point. The strap may be separable from the inside face in between the first attachment point and the second attachment point, so as to define a passageway between the inside face and the strap, through which the hand may pass when exiting the cavity.

In another aspect, the strap may be elastic, and may have a first end portion attached at the first attachment point and a second end portion attached at the second attachment point. A length of the strap from the first end portion to the second end portion may be substantially equal to a length of the inside face from the first attachment point to the second attachment point, so that when the hand covering is fastened on the user the strap remains substantially against the inside face in an absence of a pulling force applied to the strap, with the strap disposed between the user and the inside face.

In another aspect, the dorsal portion and/or the palmar portion may define a cuff portion at the proximal end, and the strap may be attached to the inside face within the cuff portion.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a hand covering having a central hand portion with an internal retaining strap for dangling the hand covering off of a user's wrist when the hand covering is not in use covering the hand.

Figure 1:
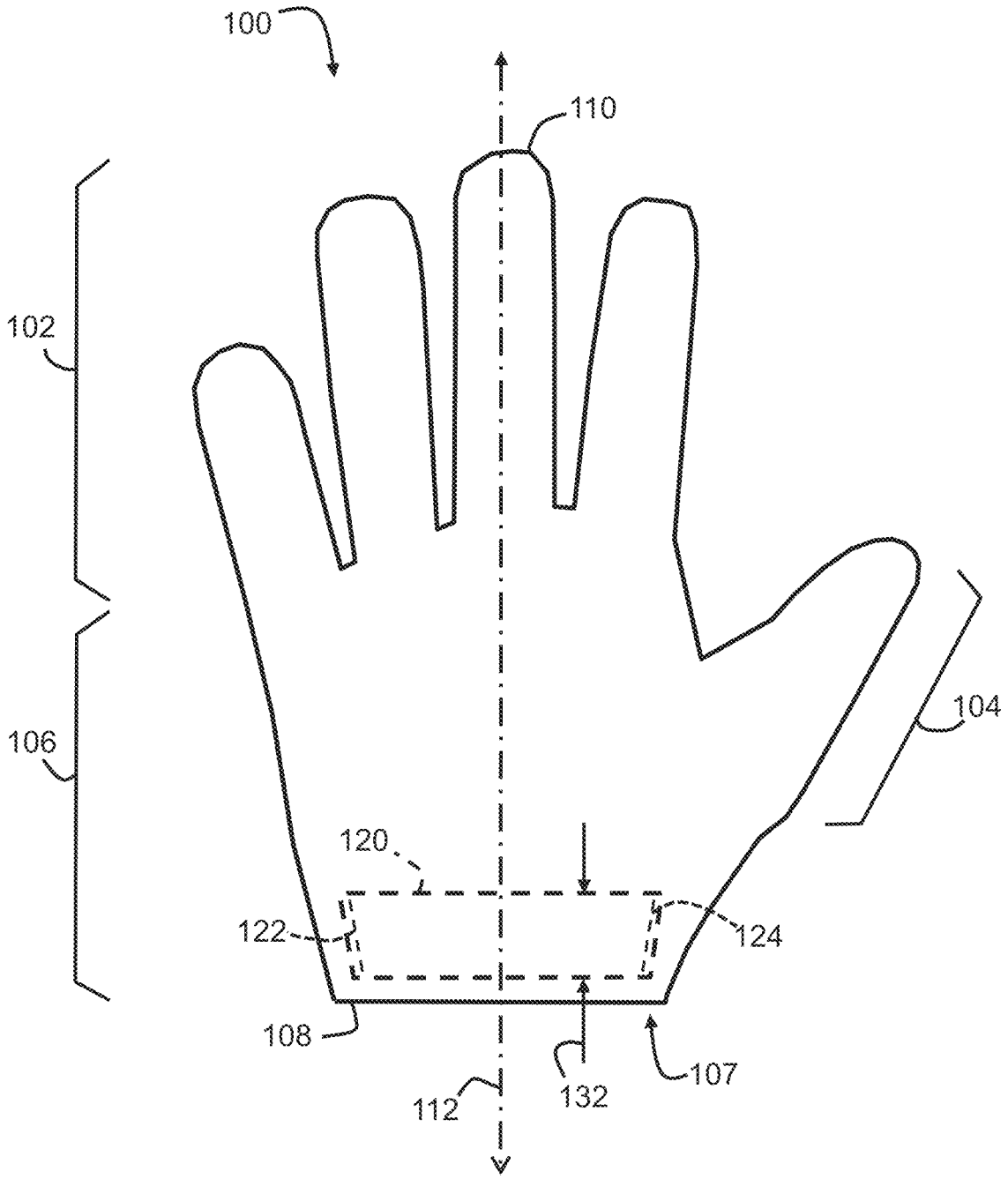
FIG. 1 is a schematic diagram of a dorsal (back) side of a hand covering according to an embodiment.
Figure 2:
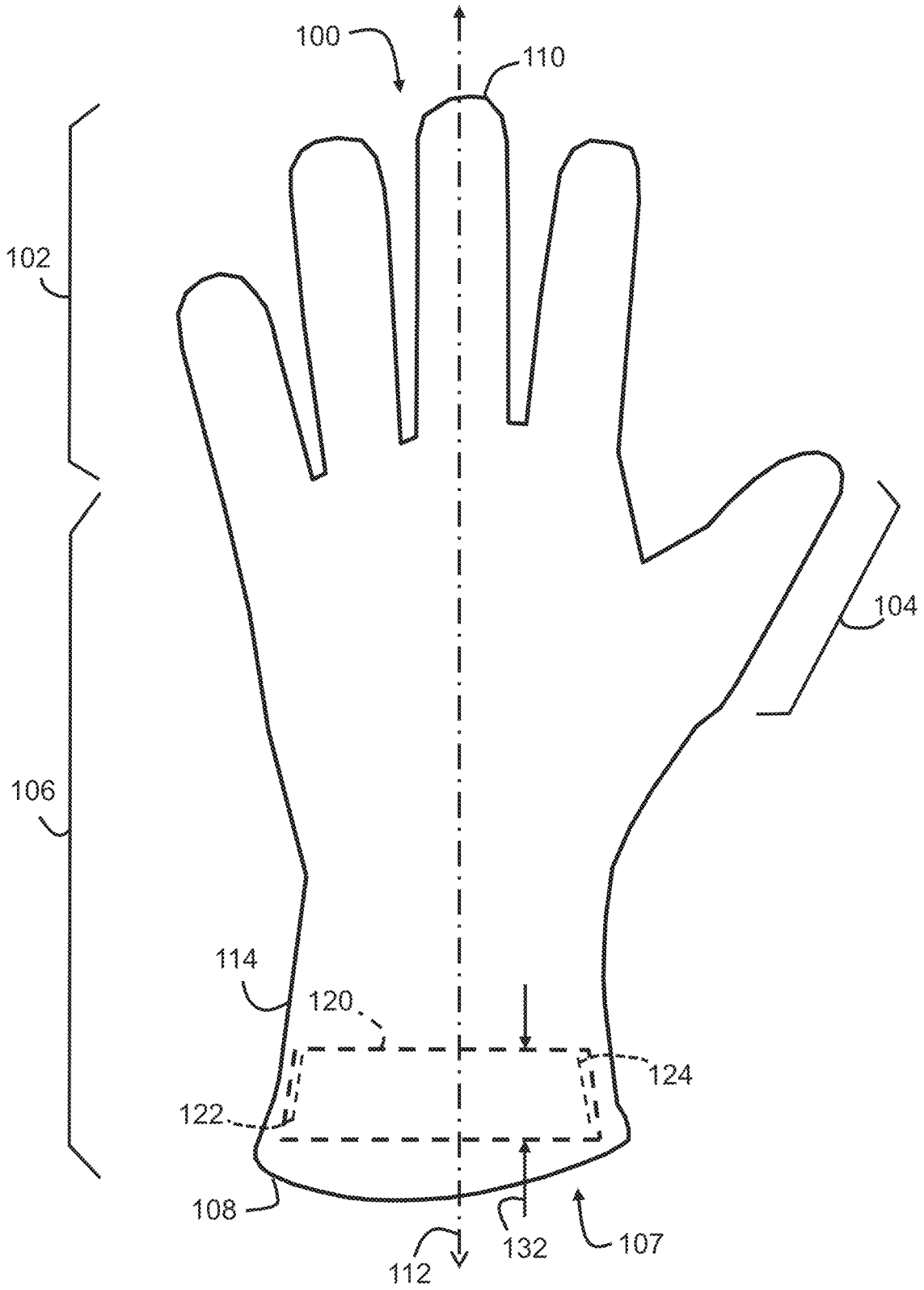
FIG. 2 is a schematic diagram of a dorsal side of a hand covering having a cuff portion, according to an embodiment.
Figure 3:
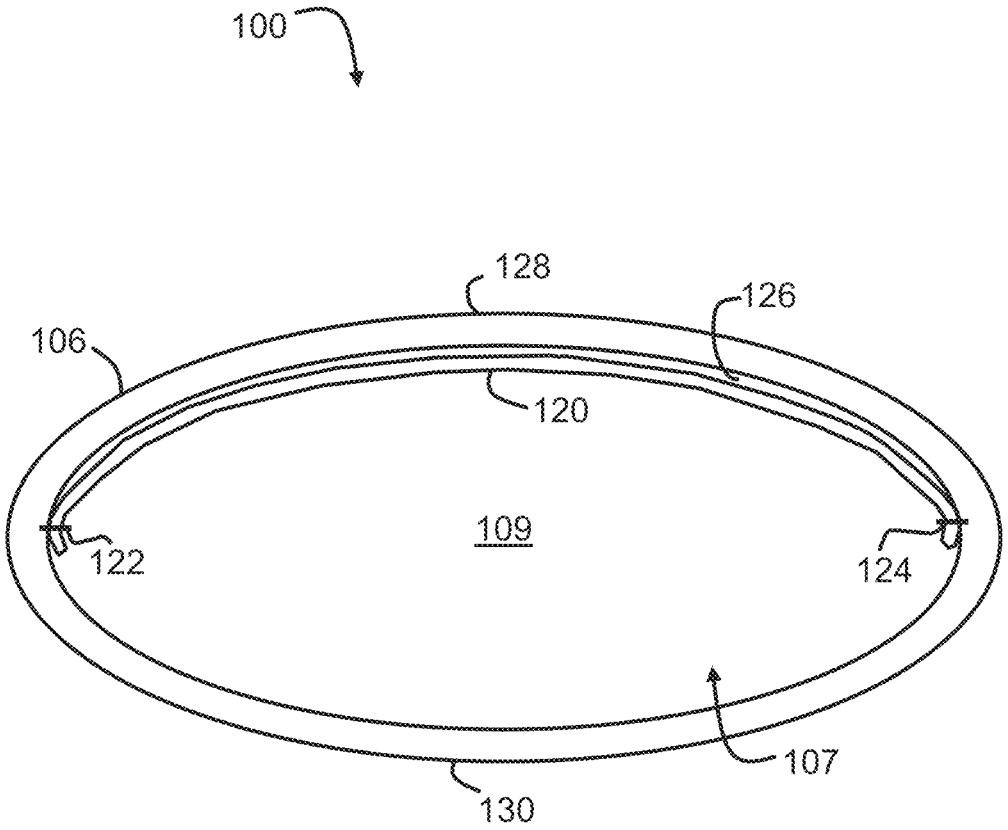
FIG. 3 is a schematic diagram of an opening of a hand covering at the proximal side, looking into the cavity of the hand covering in a direction toward the distal, finger receiving portion of the hand covering, with a retaining strap disposed at the dorsal side of the hand covering, according to an embodiment.

FIG. 1 illustrates a hand covering 100 according to an embodiment. Although hand covering 100 is shown as a glove, embodiments may be applicable to any number of types of hand coverings, such as mittens, fingerless gloves, and convertible mittens. FIG. 1 shows the side of the glove 100 that covers the back of a user's hand, and is referred to herein as the dorsal side. The side of the glove 100 opposite to the dorsal side is referred to herein as the palmar side. As shown, glove 100 may include a finger receiving portion 102, a thumb receiving portion 104, and a central hand portion 106. Glove 100 may extend generally longitudinally from a proximal end 108, which may be configured to be disposed at a wrist or forearm of a user, to a distal end 110 at the tips of the finger receiving portion 102, which may be configured to receive the fingertips of a user. Thumb receiving portion 104 may extend in a direction transverse to the longitudinal direction 112 and may be configured to receive a thumb of a user. As shown in FIGS. 1-3, central hand portion 106 may define an opening 107 through which to receive a user's hand and a cavity 109 configured to receive the central portion of the user's hand, including one or more of the palm, the back of the hand, the metacarpal bones, the carpal bones, the ulna, or the radius. Hand covering 100 may be made of any suitable woven or non-woven material, for example, cloth, knitted or felted wool, leather, rubber, latex, neoprene, silk, and metal.

As shown in FIG. 1, central hand portion 106 may extend in the proximal direction to a position generally corresponding with a wrist crease of a user wearing the glove 100. In other embodiments, central hand portion 106 may extend farther in the proximal direction to cover all or portions of the wrist and forearm of a user. For example, as shown FIG. 2, central hand portion 106 may include a cuff portion 114 configured to cover at least a portion of a forearm of a user. Cuff portion 114 may be formed of a material integral with the remaining portions of the glove 100 and/or of one or more separate pieces or panels attached to the remaining portions of the glove 100. As shown in FIG. 2, in embodiments, cuff portion 114 may increase in cross-sectional area in a direction toward the proximal end of the hand covering 100. In other embodiments, a cross-sectional area of cuff portion 114 may remain substantially constant.

Embodiments may include provisions for retaining a hand covering on the user when not being worn on the hand. For example, as represented by the hidden dashed lines in FIGS. 1-2, embodiments may provide a retaining strap 120 attached to an inside surface of the central hand portion 106 of the glove 100. Retaining strap 120 may be attached to the central hand portion 106 at a first attachment point 122 and at a second attachment point 124 spaced apart from each other by a distance. Retaining strap 120 may be separable from the central hand portion 106 in between the first attachment point 122 and the second attachment point 124. However, as shown in FIG. 3, retaining strap 120 may be configured to remain adjacent to an inside face of the central hand portion 106, when the retaining strap 120 is in a relaxed state (e.g., not being stretched or pulled away from the central hand portion 106). In embodiments, retaining strap 120 may be configured to lay flat and substantially against the inside face of the central hand portion 106, when retaining strap 120 is in a relaxed state when the glove 100 is being worn by a user, with the retaining strap 120 disposed between the central hand portion 106 of the glove 100 and the hand, wrist, and/or forearm of the user. To accommodate a situation in which a user wishes to remove the glove 100 from the user's hand, yet still retain the glove 100 on the user's wrist and/or forearm, the retaining strap 120 may be configured to separate from the central hand portion 106 as the user withdraws her hand from the glove 100 and passes her fingers and hand through the passageway 126 between the inside face of the central hand portion 106 and the retaining strap 120. This operation is discussed in more detail below.

To allow for the separation of the retaining strap 120 from the inside face of the central hand portion 106 and for the passing of a hand through the passageway 126, retaining strap 120 may extend in a direction generally lateral to the longitudinal direction 112. Although shown generally perpendicular to the longitudinal direction 112 in FIGS. 1-2, retaining strap 120 may longitudinally extend at a different angle to direction 112. In addition, as shown in FIGS. 1-2, retaining strap 120 may be disposed adjacent to the proximal end of central hand portion 106, which may allow the retaining strap 120 to more conveniently release from the cavity 109 and allow the remaining portions of the glove 100 to be held by (e.g., dangle from) the retaining strap 120. In alternative embodiments, however, retaining strap 120 may be disposed more toward the finger receiving portion, which would still provide a desired result, though may require more folding or bunching of the remaining portion of the glove 100.

To allow the remaining portion of the glove 100 to be held by (e.g., dangling underneath) a user's hand, wrist, and/or forearm, a retaining strap 120 may be attached to the central hand portion 106 so as to define a passageway 126 at a dorsal side 128 of the glove 100, as shown in FIGS. 1-3. In this configuration, as the user withdraws her hand from the glove 100, the user may pass her hand upward toward the dorsal side 128 of the glove 100 and through the passageway 126, such that the remaining portion of the glove 100 swings underneath the user's hand, wrist, and/or forearm. Alternatively, a retaining strap 120 may be positioned within the cavity 109 to provide different directions in which to pass the user's hand and different positions at which to hold the remaining portion of the glove 100.

Figure 4:
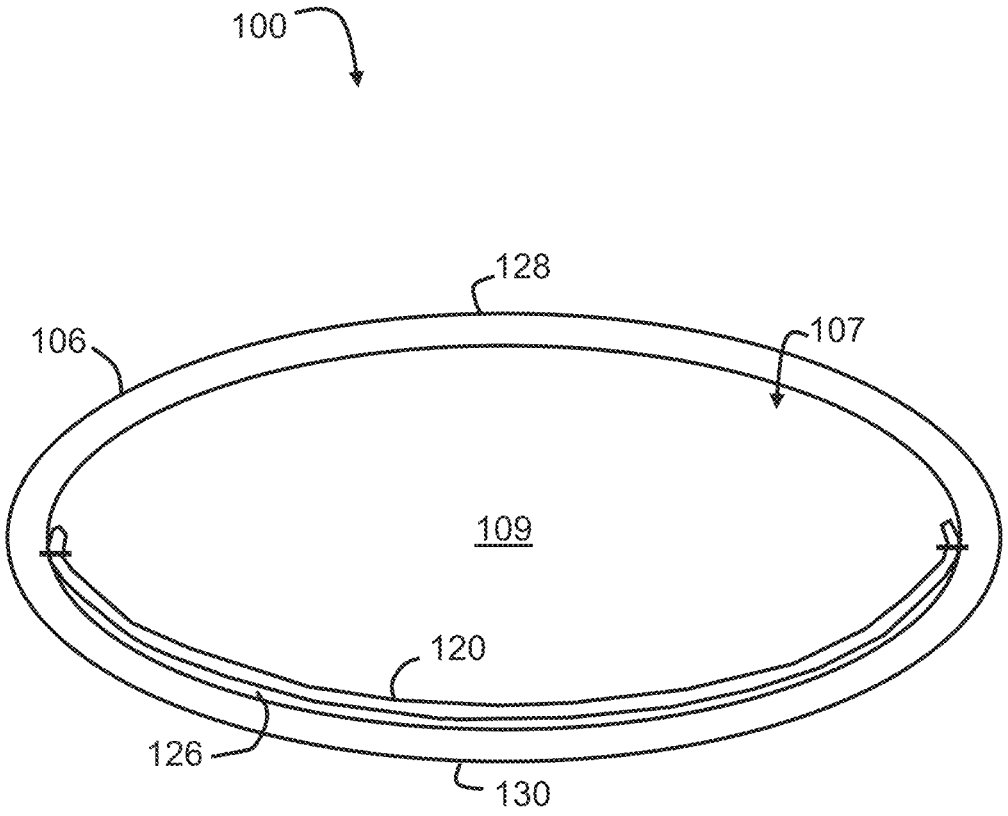
FIG. 4 is a schematic diagram of an opening of a hand covering at the proximal side, looking into the cavity of the hand covering in a direction toward the distal, finger receiving portion of the hand covering, with a retaining strap disposed at the palmar side of the hand covering, according to an embodiment.

For example, as shown FIG. 4, retaining strap 120 may be configured to provide a passageway 126 at a palmar side 130 of glove 100. In this configuration, as the user withdraws her hand from the glove 100, the user may pass her hand downward toward the palmar side 130 of the glove 100, such that the remaining portion of the glove 100 swings up and over the user's hand, wrist, and/or forearm.

Figure 5:
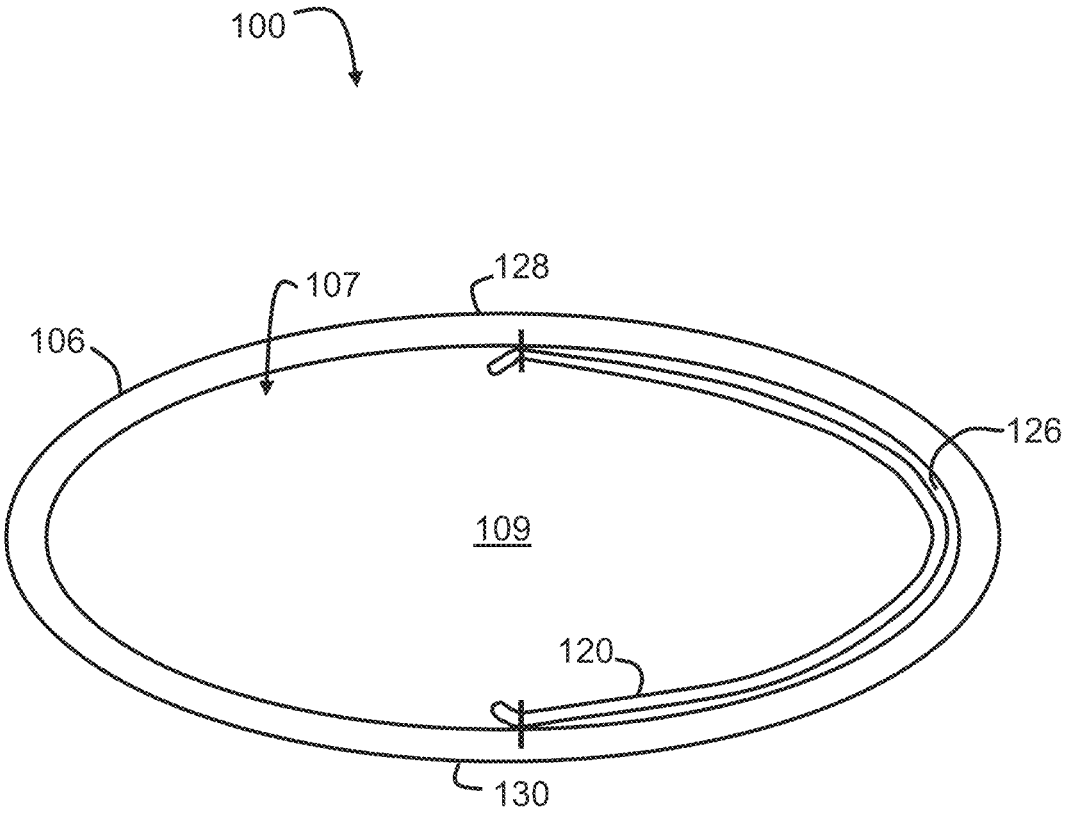
FIG. 5 is a schematic diagram of an opening of a hand covering at the proximal side, looking into the cavity of the hand covering in a direction toward the distal, finger receiving portion of the hand covering, with a retaining strap disposed at the lateral side of the hand covering, according to an embodiment.

As another example, as shown in FIG. 5, retaining strap 120 may be configured to provide a passageway 126 at a side of the glove 100 generally in between the palmar side 130 and the dorsal side 128. In this configuration, as the user withdraws her hand from the glove 100, the user may pass her hand toward the side of the glove 100 where the retaining strap 120 is disposed, such that the remaining portion of the glove 100 swings to the side of the user's hand, wrist, and/or forearm. Although shown on one side in FIG. 5, an alternative embodiment may provide the retaining strap 120 on the other side. In other embodiments, a retaining strap 120 may be positioned at any radial position around the inside face of the central hand portion 106.

In addition, although the embodiments of FIGS. 3-5 illustrate a retaining strap extending approximately halfway around the inside perimeter of the central hand portion 106, other embodiments may include shorter or longer retaining straps, which may accommodate different desired sizes of the passageway through which to pass a hand, and which may provide a tighter or looser fit when withdrawing the hand and when in the retaining configuration. In embodiments, a retaining strap may extend nearly the entire inside perimeter around a releasable cuff portion of a central hand portion, which is described in more detail below.

In embodiments, the retaining strap may also be shaped to promote a flat engagement with the inside face of the central hand portion. For example, in terms of length, a retaining strap may be substantially equal in length to the distance between the attachment points on the central hand portion, so that the retaining strap is in a relaxed state, substantially flat against the inside face of the central hand portion, when the glove is worn on a hand. In addition, referring to FIGS. 1-2, in embodiments, a width 132 of retaining strap 120 may be relatively wide to avoid the retaining strap's folding, rolling, twisting, or otherwise moving to a non-flat state. In embodiments having a central hand portion 106 with no cuff portion, width 132 may be at least about one-quarter of the longitudinal length (i.e., in the longitudinal direction 112) of the central hand portion 106. In embodiments having a central hand portion 106 with a cuff portion, width 132 may be at least about one-quarter of the longitudinal length (i.e., in the longitudinal direction 112) of the cuff portion.

Embodiments may also include provisions for facilitating the transformation of a retaining strap from a stowed position to a released position in a retaining configuration of a hand covering. In aspects, a retaining strap may be elastic so that the retaining strap may stretch and increase in length as a hands passes through the passageway between the retaining strap and the central hand portion. Then, when the hand is completely through the passageway and the retaining strap is positioned at the wrist and/or forearm of the user, the retaining strap may retract in length to hold the hand covering on the user's wrist and/or forearm. Then, when the user dons the hand covering again, or completely removes the hand covering, the retaining strap may stretch again to allow passage of the hand and then retract again to the stowed position. In embodiments, a retaining strap may be made of any material capable of stretching in response to a pulling force and returning to substantially its original size and shape after the pulling force is removed. The elastic material may have this capability in response to a pulling force in any direction and to pulling forces in multiple directions simultaneously. In embodiments, a retaining strap may be a woven fabric (e.g., braided or knit), a non-woven fabric, a mesh, an elastic cord, or other suitable material. An example of a suitable elastic material is spandex (elastane) fiber material produced by, for example, Dorlastan Fibers and Monofil GmbH of Dormagen, Germany, or INVISTA Inc. of Wichita, Kans. Other examples include LYCRA® (synthetic elastance fiber) from INVISTA, flexible polyurethane foam, and injection molded elastomeric materials.

In embodiments, a retaining strap may be attached to a central hand portion by any suitable means, such as by stitching, stapling, welding, or adhesive.

Embodiments may therefore provide surprising benefits in accommodating the rapid and convenient removal of a hand covering, while allowing the hand covering to be retained on the user for rapid and convenient retrieval when the user is ready to don the hand covering again. This rapid and convenient operation is especially useful for activities requiring quick action such as during critical work operations (e.g., firefighters, first responders, welders, and military) and during sports activities (e.g., lacrosse, ice hockey, and fencing). As an example, FIGS. 6-17 illustrate embodiments of a hand covering having a retaining strap in the context of lacrosse gloves, and methods for using the hand covering.

Figure 6:
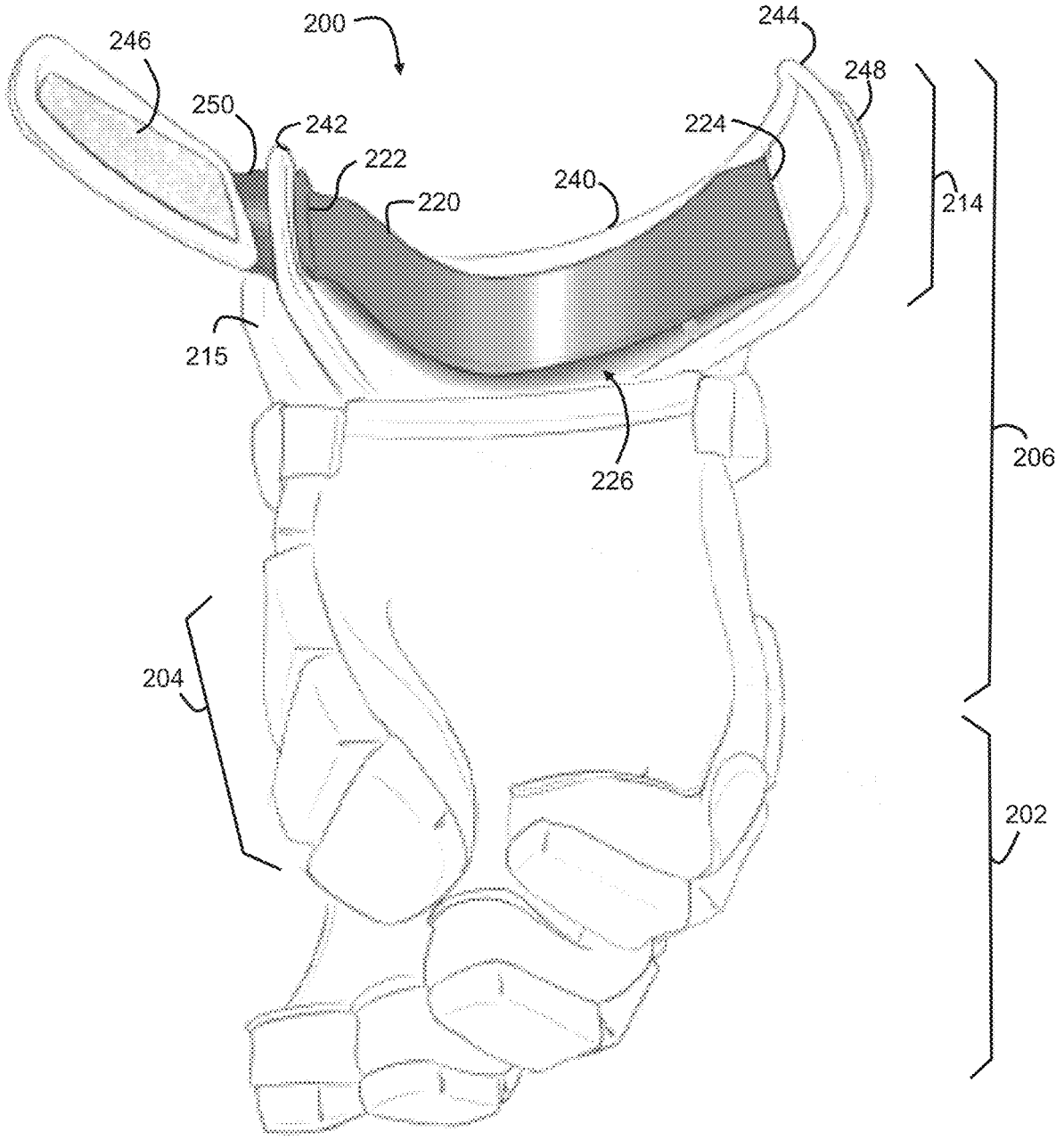
FIG. 6 is a schematic diagram of a palmar side of a hand covering having a releasable and adjustable cuff portion with a retaining strap, shown in an unfastened state, according to an embodiment.

Referring to FIG. 6, an embodiment provides a hand covering in the form of a lacrosse glove 200, which includes a finger receiving portion 202, a thumb receiving portion 204, and a central hand portion 206. Central hand portion 206 may include a cuff portion 214, which in this embodiment is configured to be releasable and adjustable around a user's hand, wrist, and/or forearm. Cuff portion 214 may be a subcuff and the glove 200 may have an outer cuff 215 positioned over the subcuff. Cuff portion 214 may include a cuff panel 240 that has a first end 242 and a second end 244, and may wrap around and enclose a user's hand, wrist, and/or forearm, bringing the ends 242, 244 of the cuff panel 240 toward each other. Cuff portion 214 may also include fasteners at each of the ends 242, 244, which may hold the ends 242, 244 at a desired distance of separation, or in contact or overlapping, with cuff portion 214 enclosing the hand, wrist, and/or forearm of the user. In an embodiment, as shown in FIG. 6, end 242 may include one portion 246 of a hook-and-loop fastener and end 244 may include the other portion 248 of a hook-and-loop fastener. Any other suitable releasable fasteners may be used, such as buckles, snaps, or buttons.

In embodiments, glove 200 may be configured to closely fit a hand using a particular pattern of different material sections including, for example, liner sections (e.g., formed of leather, synthetic woven or knit materials, or the like), breathable mesh sections, stretch joints formed of elastic material (e.g., LYCRA® (synthetic elastance fiber) or other stretch nylon, polyester, DACRON® (polyester fiber), neoprene, COOLMAX® (produced by INVISTA of Wichita, Kans.), or suitable material), and shock absorbing cushions that provide general protection against strikes and blows to a player's hand. Shock absorbing cushions may be attached to the glove 200 over certain defined areas and sewn thereto in a particular pattern so as to cover dorsal portions of both the hand and wrist. Shock absorbing cushions may be made of one or more blocks of micro-cellular foam, such as open cell, urethane foam (e.g., PORON® (microporous plastic material), PVC nitrile foam, or another suitable impact-absorbing closed cell foam material). The shock absorbing blocks may be encased in durable, water-resistant material, such as natural leather, double knit polyester, woven nylon cordura, synthetic leather (e.g., polyurethane coated material or microleather), or other suitable fabric material. The various cushions on the dorsal side may be separated from one another by breaks that provide flexibility between the cushions when a wearer's hand is flexed. Stitching used to attach the components of glove 200 may be a durable, water-resistant thread, such as nylon, natural fibers, and metallic threads. In embodiments, instead of sewn and fabric-covered shock absorbing cushions, a glove may have shock absorbing cushions that are molded or die-cut, which may be fused or otherwise attached to a substrate, such as scrim or other fabrics.

To provide the hand-covering-retaining features and configurations described above, cuff portion 214 may have a retaining strap 220 attached to the cuff panel 240. Retaining strap 220 may be elastic and may be attached to the inside of the cuff panel 240, for example, by sewn stitches at a first attachment point 222 and a second attachment point 224. Retaining strap may be separable from cuff panel 240 between attachment points 222, 224, to create a passageway 226 through which to pass a hand of the user. In embodiments in which a retaining strap is disposed in a releasable and adjustable cuff portion of a central hand portion, to promote a flat nestling of the retaining strap 220 against the inside surface of the cuff panel 240, the width of retaining strap 220 may be at least one-quarter the width of the cuff panel 240. In the example of FIG. 6, the width of retaining strap 220 is over three-quarters the width of cuff panel 240. In other embodiments, the width of retaining strap 220 may be substantially equal to the width of cuff panel 240.

Figure 7:
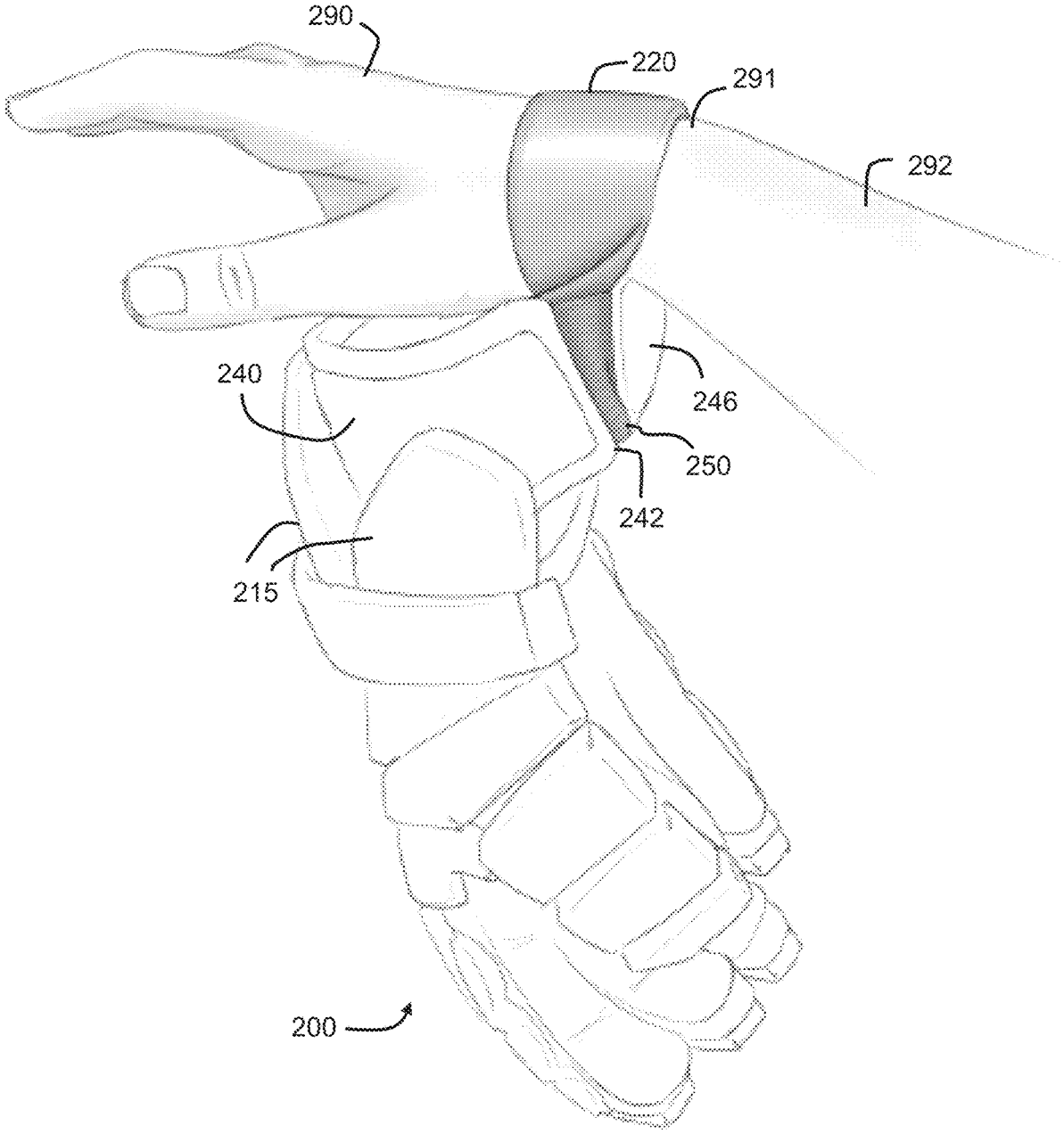
FIG. 7 is a schematic diagram of the hand covering of FIG. 6 in a retaining configuration, according to an embodiment.

As illustrated in FIGS. 6-7, the elastic retaining strap 220 may allow a player to quickly slip off the glove 200 and have the glove 200 hang, or dangle, at the hand 290, wrist 291, and/or forearm 292 of the player. The retaining configuration shown in FIG. 7 may be useful during water breaks, and during quick adjustments to the player's stick or padding (which would be more difficult to accomplish with the glove on).

Figure 8:
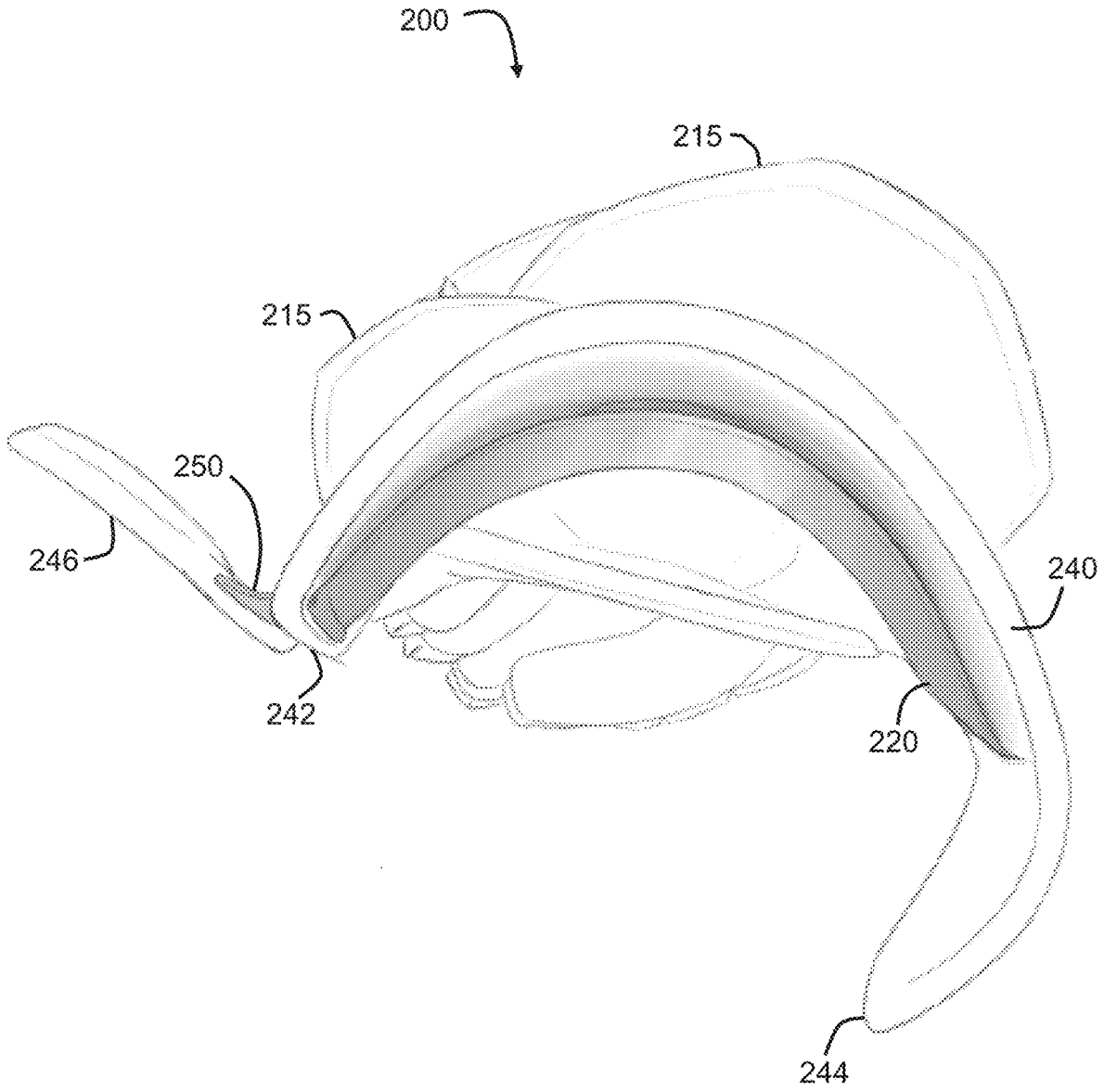
FIG. 8 is a schematic diagram of a proximal side of the hand covering of FIG. 6, shown in an unfastened state, according to an embodiment.

As shown in FIG. 8, the retaining strap 220 may be nestled up against the cuff panel 240 of the cuff portion 214 of the glove 200, so that a player may insert her hand into the glove 200 unimpeded and may comfortably wear the glove 200 with the retaining strap positioned flat and substantially against the inside surface of the cuff panel 240.

Figure 9:
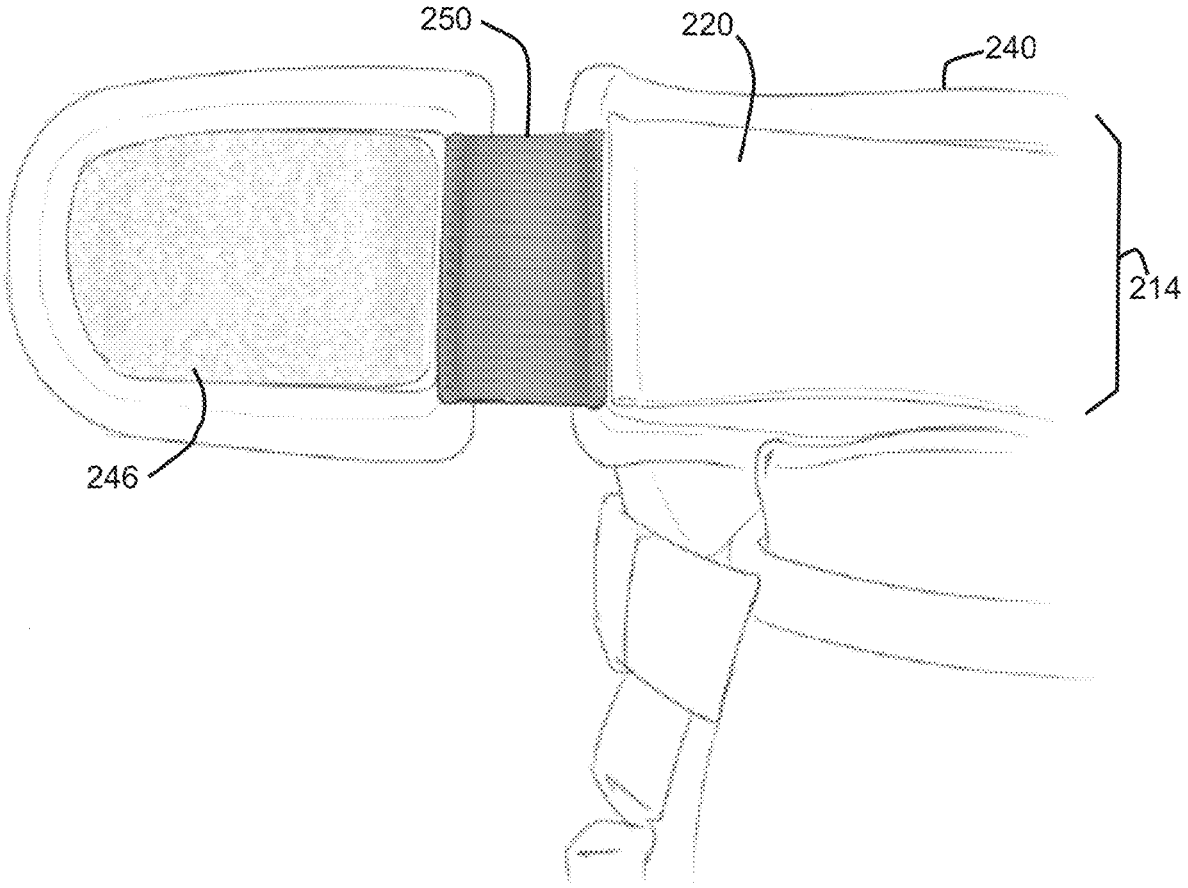
FIG. 9 is a schematic diagram of an enlarged partial view of the hand covering of FIG. 6, showing an elastic portion of a cuff portion, according to an embodiment.

In embodiments, a cuff portion may include provisions for adjusting the fit of the cuff portion around a user's wrist and/or forearm, for releasing the cuff portion from the user, and for allowing a user to access a passageway created by a retaining strap without releasing or adjusting the cuff portion. For example, as illustrated in the enlarged partial view of FIG. 9, cuff portion 214 may include a releasable fastener, such as a hook-and-loop fastener, buckle, snap, or button. As one example, FIGS. 6 and 9 illustrate one portion 246 of a hook-and-look fastener, which may be engaged and disengaged from the opposite portion 248 to fasten and release the cuff portion 214 and to provide a desired fit of the cuff portion 214. In addition, cuff portion 214 may include an elastic portion 250, which may stretch and allow additional room for a player to maneuver her hand back through cuff portion 214 and into and through the passageway 226, all without disconnecting the releasable fastener.

Figure 10:
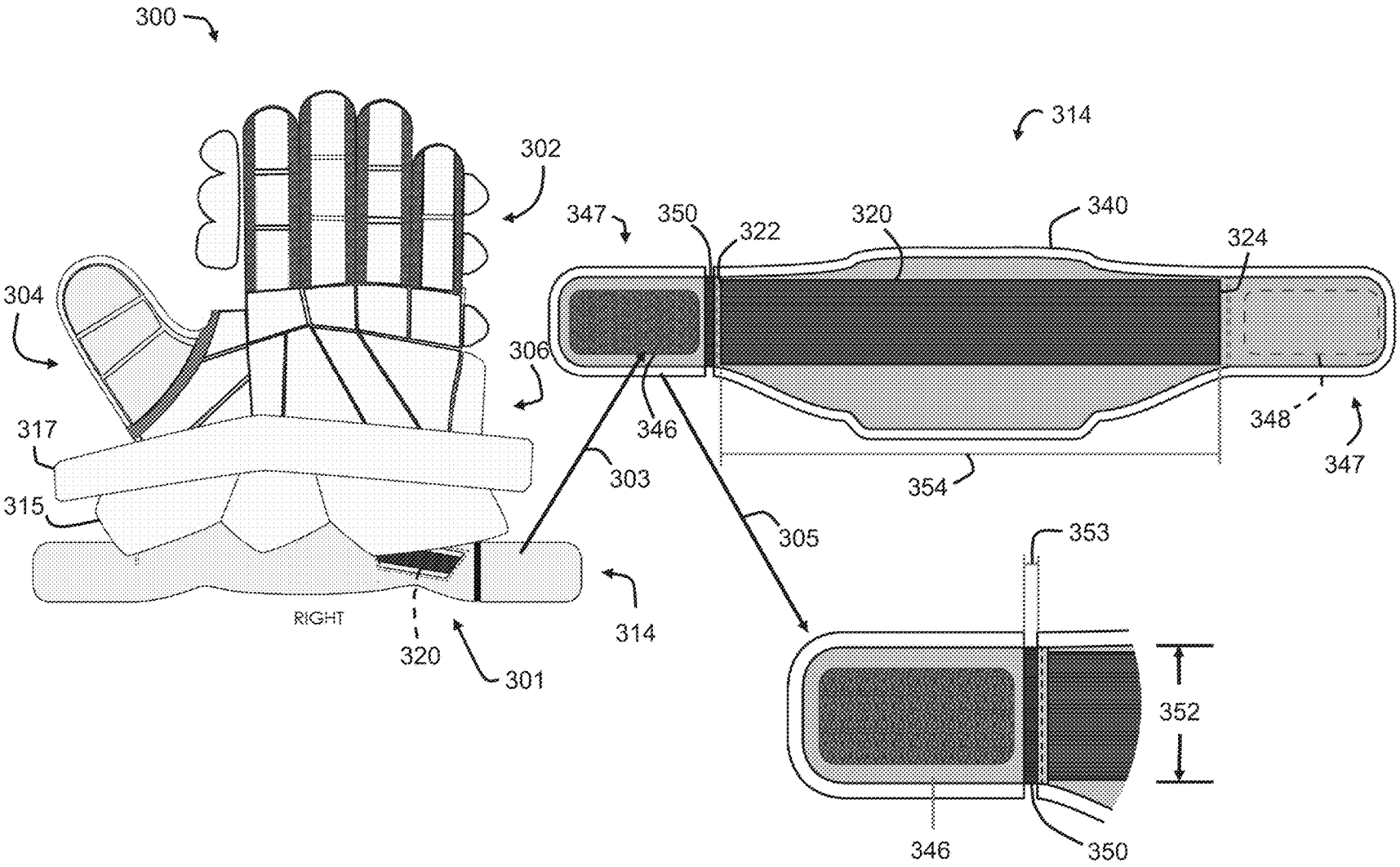
FIG. 10 is a schematic diagram of another embodiment of a hand covering, showing a cuff portion in isolation, and an enlarged partial view of a fastener, an elastic portion, and a retaining strap of the cuff portion.

FIG. 10 illustrates another embodiment of a hand covering 300 having a retaining strap 320, with the cuff portion 314 and retaining strap 320 shown in isolation for clarity. In this embodiment, hand covering 300 is configured for a right hand and is shown in its flat pattern, looking at the dorsal side in FIG. 10. Hand covering 300 may include a finger receiving portion 302, a thumb receiving portion 304, and a central hand portion 306. Central hand portion 306 may include a cuff portion 314, which in this embodiment is a subcuff. Hand covering 300 may also include an outer cuff 315 and a wrist roll 317 over the outer cuff 315. As shown in the partial cutaway view 301, cuff portion 314 may include a retaining strap 320 attached to the inside of the cuff portion 314.

In FIG. 10, the isolated view 303 of the cuff portion 314 illustrates the inside of the cuff portion 314. As shown, cuff portion 314 may include a cuff panel 340, a retaining strap 320, an elastic portion 350, and a releasable fastener 347. Retaining strap 320 may be elastic and may be attached to the inside of the cuff panel 340 at a first attachment point 322 and a second attachment point 324, with the retaining strap 320 separable from the inside face of the cuff panel 340 in between the attachment points 322, 324. Releasable fastener 347 may include a first portion 346 and a second portion 348, such as a hook portion and loop portion of a hook-and-loop fastener. In an embodiment, first portion 346 may be attached to an independent piece of padding, which is attached to the cuff panel 340 by elastic portion 350. In one implementation, elastic portion 350 may be an elastic strap having a width 352 of about 25 mm and a length 353 of about 8 mm (as represented in the isolated partial view 305), and retaining strap 320 may have length 354 of about 190 mm (as represented in the isolated partial view 303). Elastic portion 350 may allow the cuff portion 314 to increase and decrease in size when releasable fastener 347 is fastened, to allow a user to withdraw her hand back through the fastened cuff portion 314 and through the passageway created by the retaining strap 320, as described above.

Referring to FIG. 10, the length 354 of retaining strap 320, when in a relaxed state, may be substantially equal to the distance between the first attachment point 322 on the cuff panel 340 and the second attachment point 324 on the cuff panel 340. In this manner, the retaining strap 320 may stay nestled against the inside face of the cuff panel 340 before the hand covering 300 is donned by a user (e.g., so as not to impede the entry of the hand) and when the hand covering 300 is being worn on the hand (e.g., so as not to cause discomfort or obtrusion). Retaining strap 320 may be elastic so that when the user is ready to place the hand covering 300 in a retaining configuration, the user may stretch the retaining strap to increase the size of the passageway between the retaining strap 320 and the inside face of the cuff panel 340, and to move the retaining strap 320 over the hand of the user. After moving over the largest dimension of the hand of the user, the elastic retaining strap 320 may then retract to securely hold the hand covering 300 on the hand, wrist, and/or forearm of the user.

FIGS. 11-17 illustrate methods of using a hand covering according to embodiments of the present disclosure.

Figure 11:
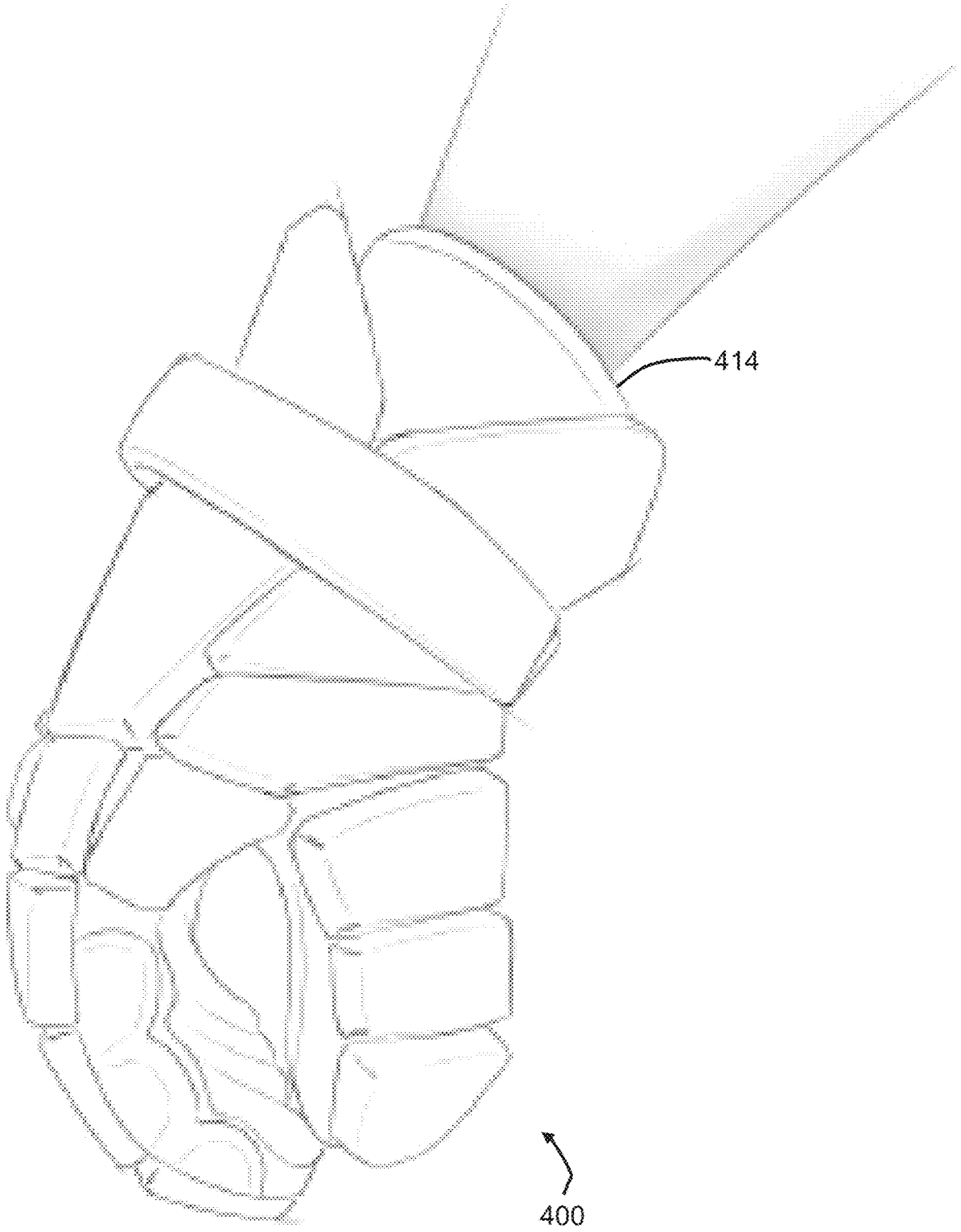
FIGS. 11-14 are a schematic diagrams illustrating a method of using a hand covering with a retaining strap, according to an embodiment.
Figure 12:
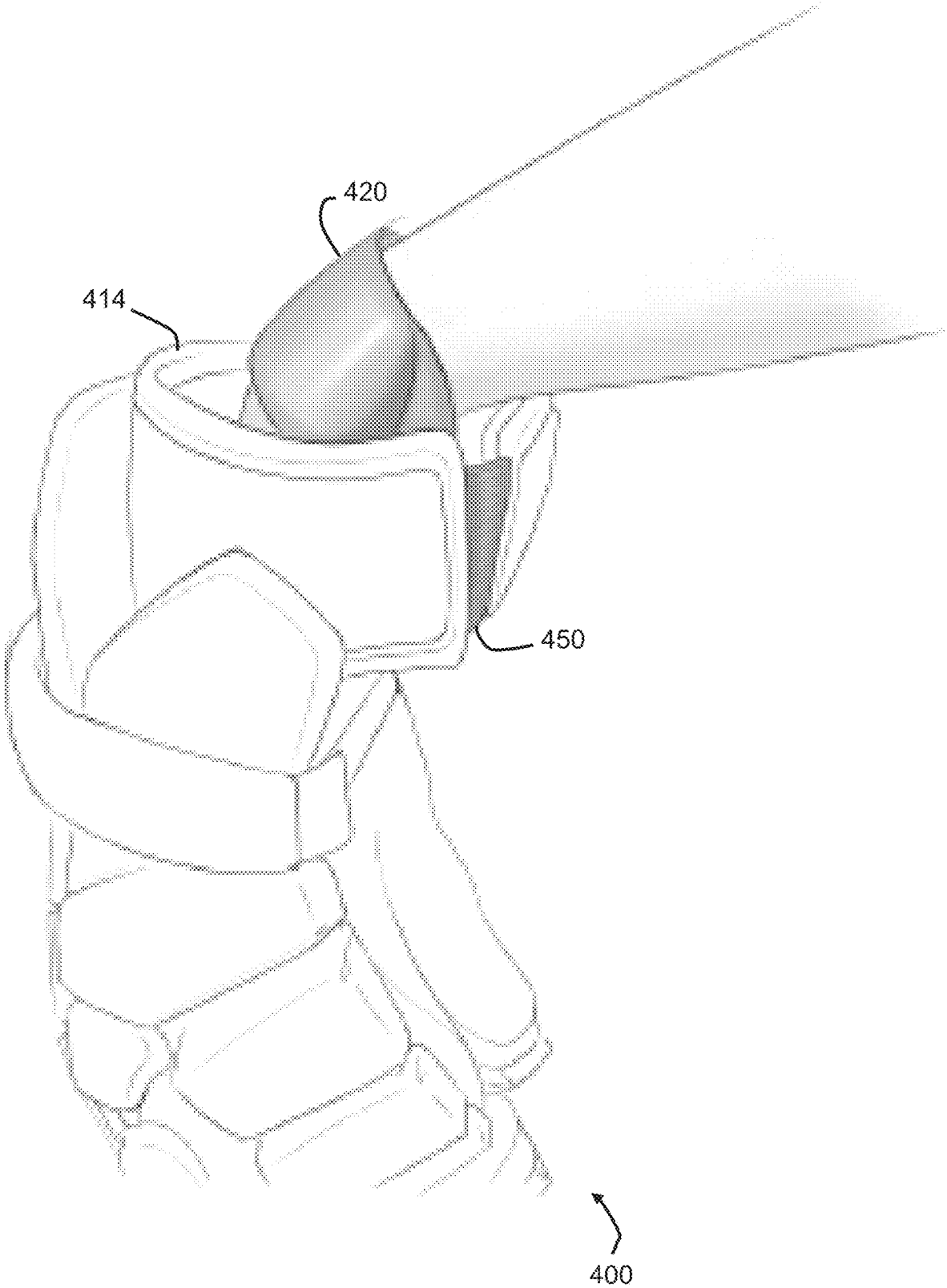
Figure 13:
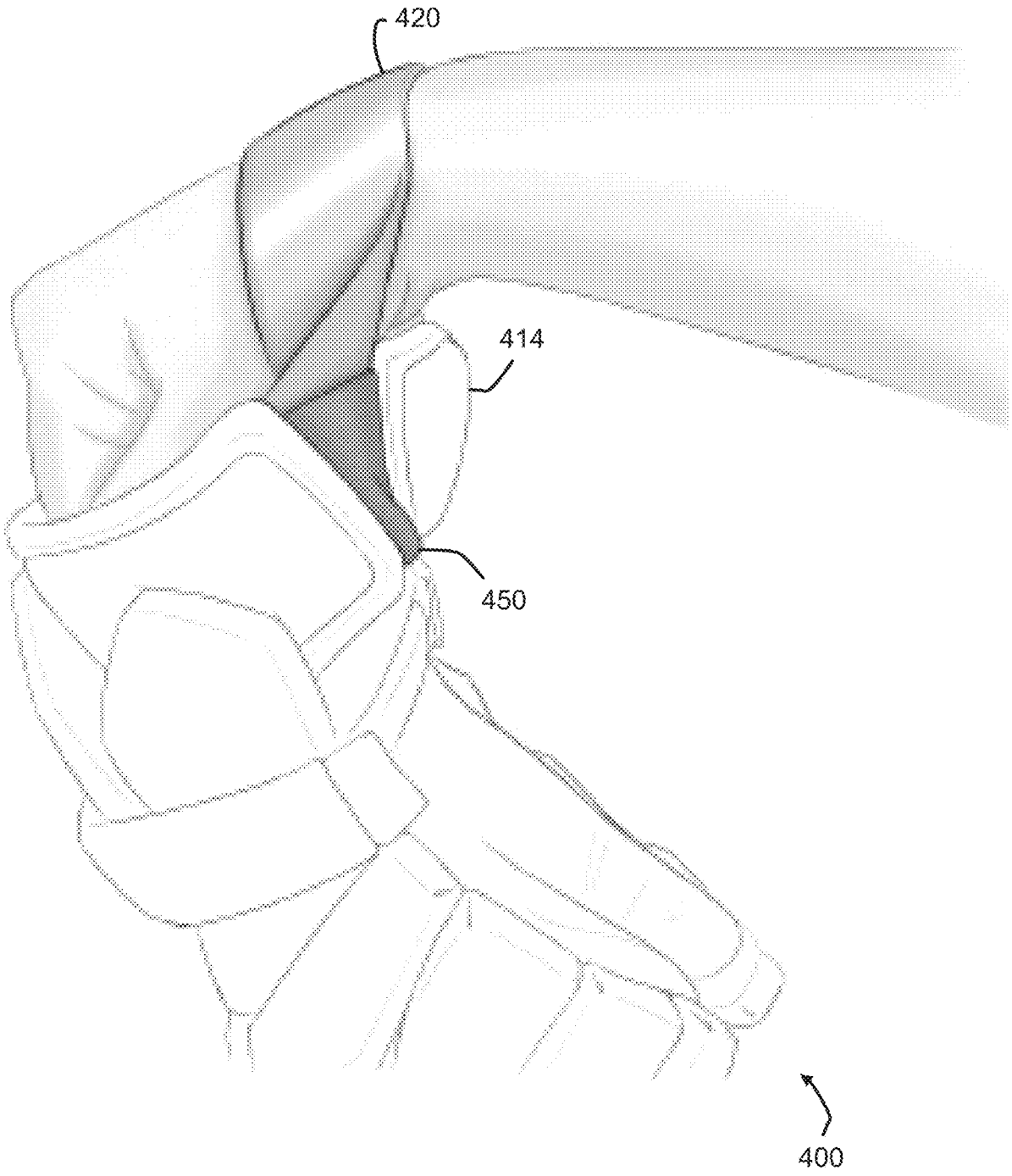
Figure 14:
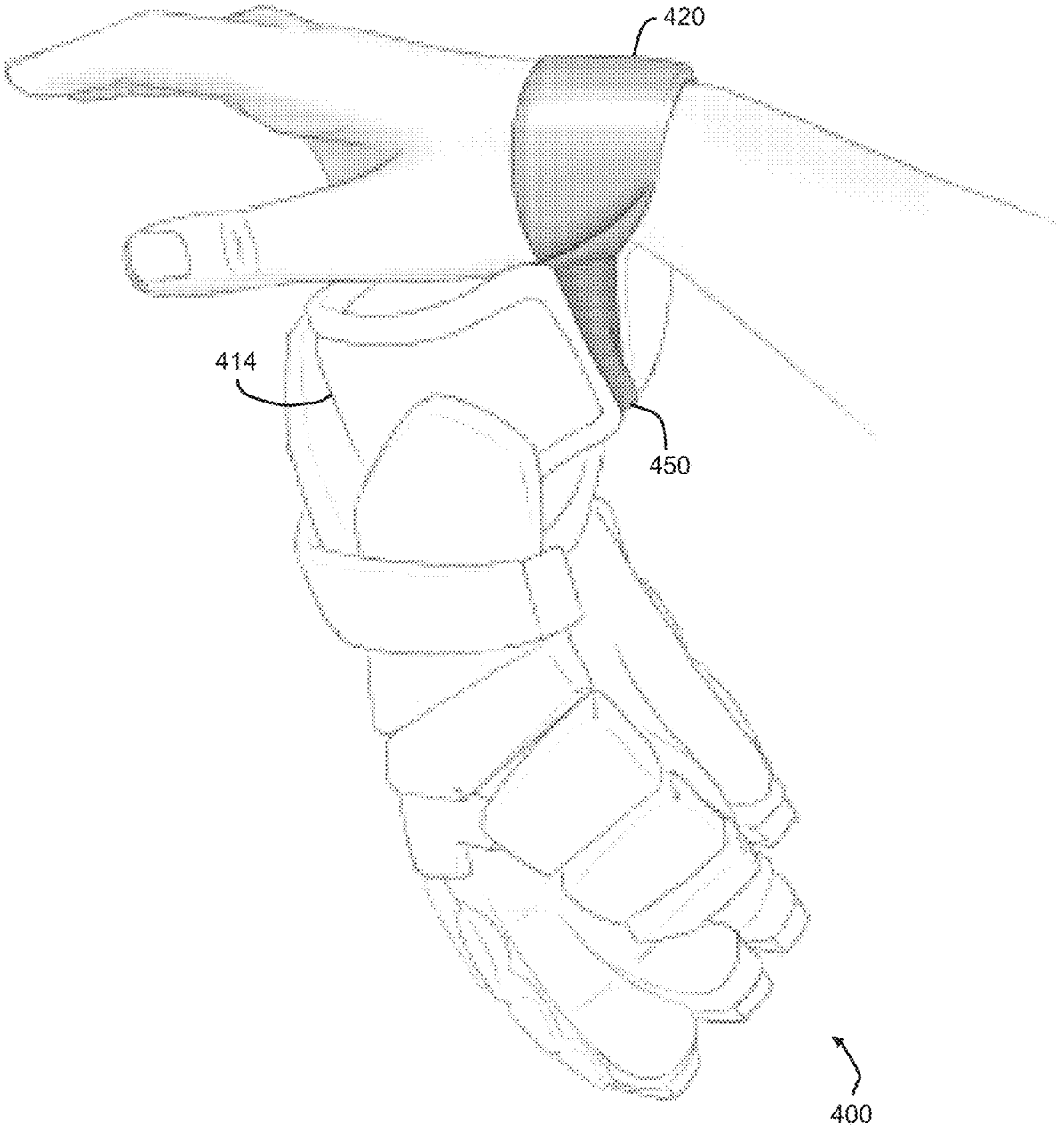
Figure 15:
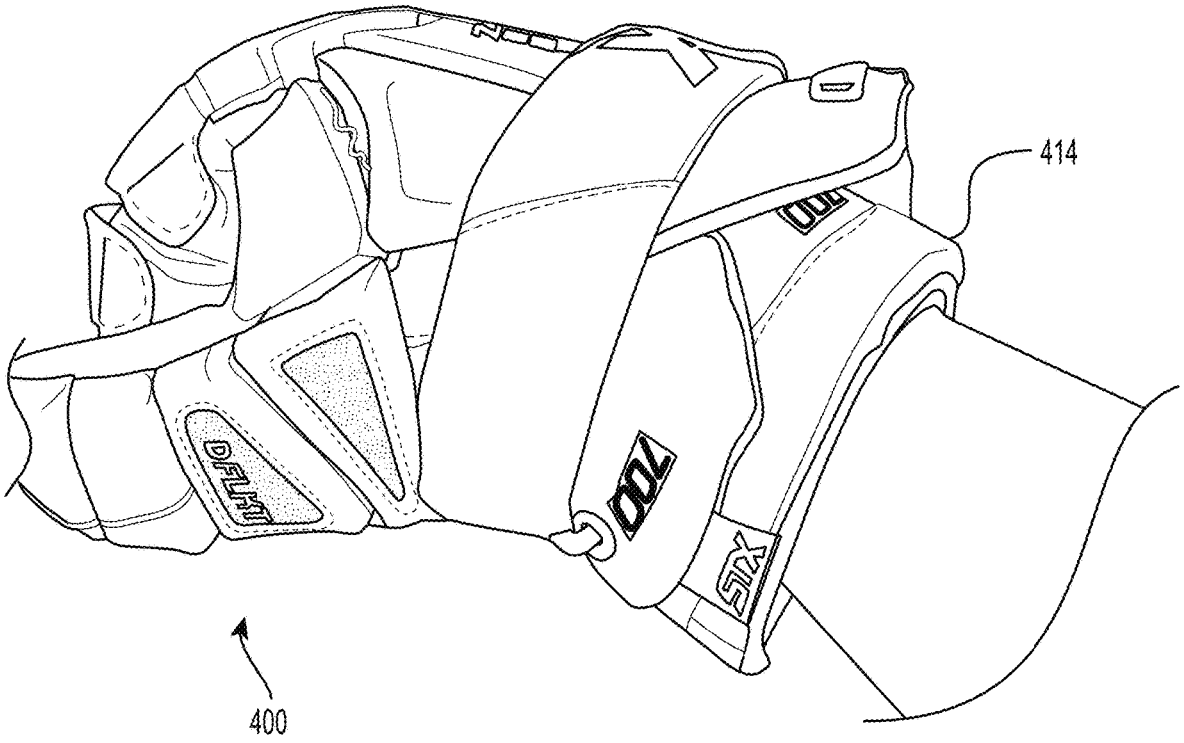
FIGS. 15-17 are images illustrating a method of using a hand covering with a retaining strap, according to an embodiment.
Figure 16:
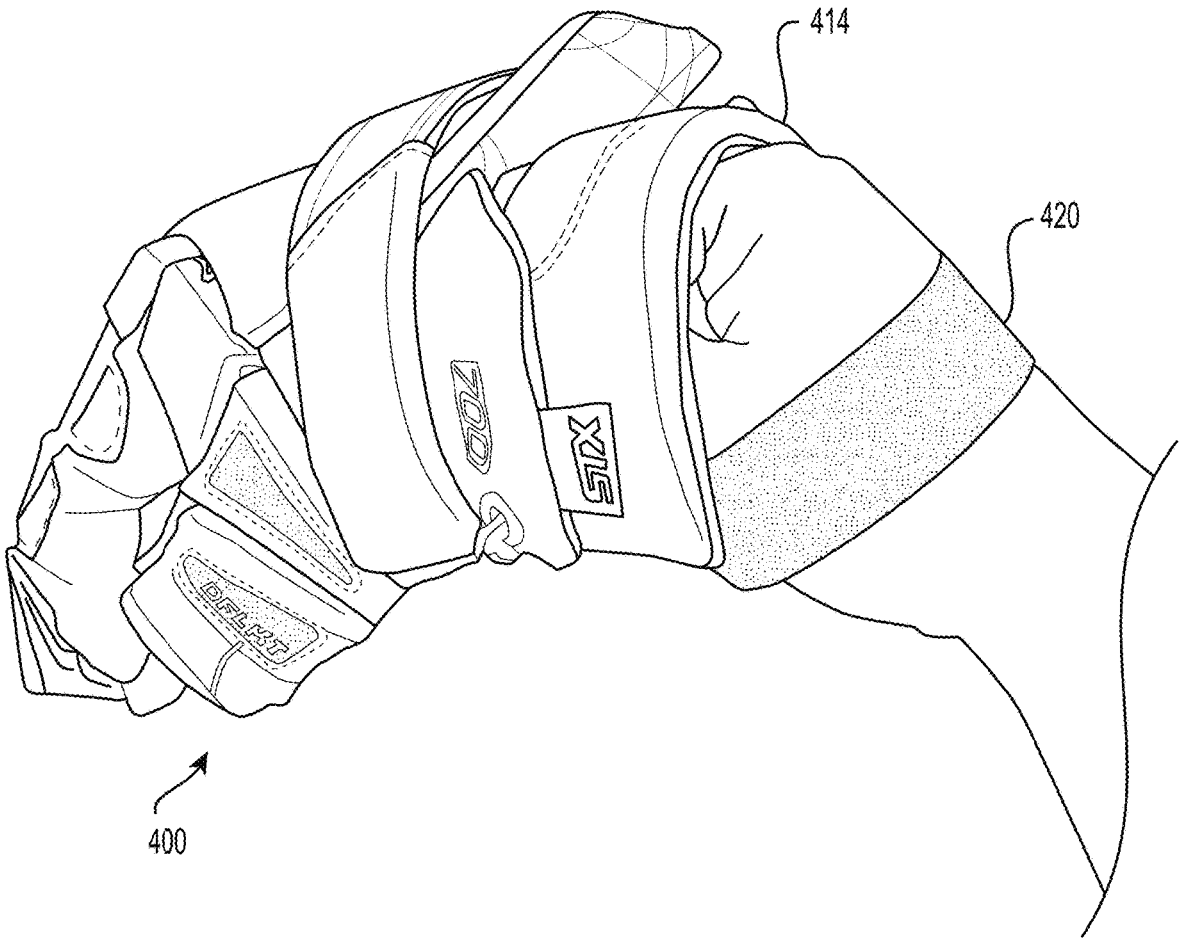

As shown in FIGS. 11 and 15, starting with a user wearing a glove 400, the user can pull his hand out of the glove 400 without altering any fastened cuff portion 414 because of the elastic portion 450 of the cuff portion 414. As shown in FIGS. 12 and 16, when pulling the hand out of the glove, the retaining strap may catch and hang onto the top of the user's hand. As shown in FIG. 13, the elastic portion 450 of the cuff portion 414 may allow the cuff portion 414 to expand to allow the user's hand to be withdrawn from the glove 400 without disconnecting the releasable fastener on the cuff portion 414. Then, as shown in FIGS. 14 and 17, the retaining strap 420 may hold onto the top of the user's hand, wrist, and/or forearm and may allow the glove 400 to hang out of the way of the user's fingers.

Figure 17:
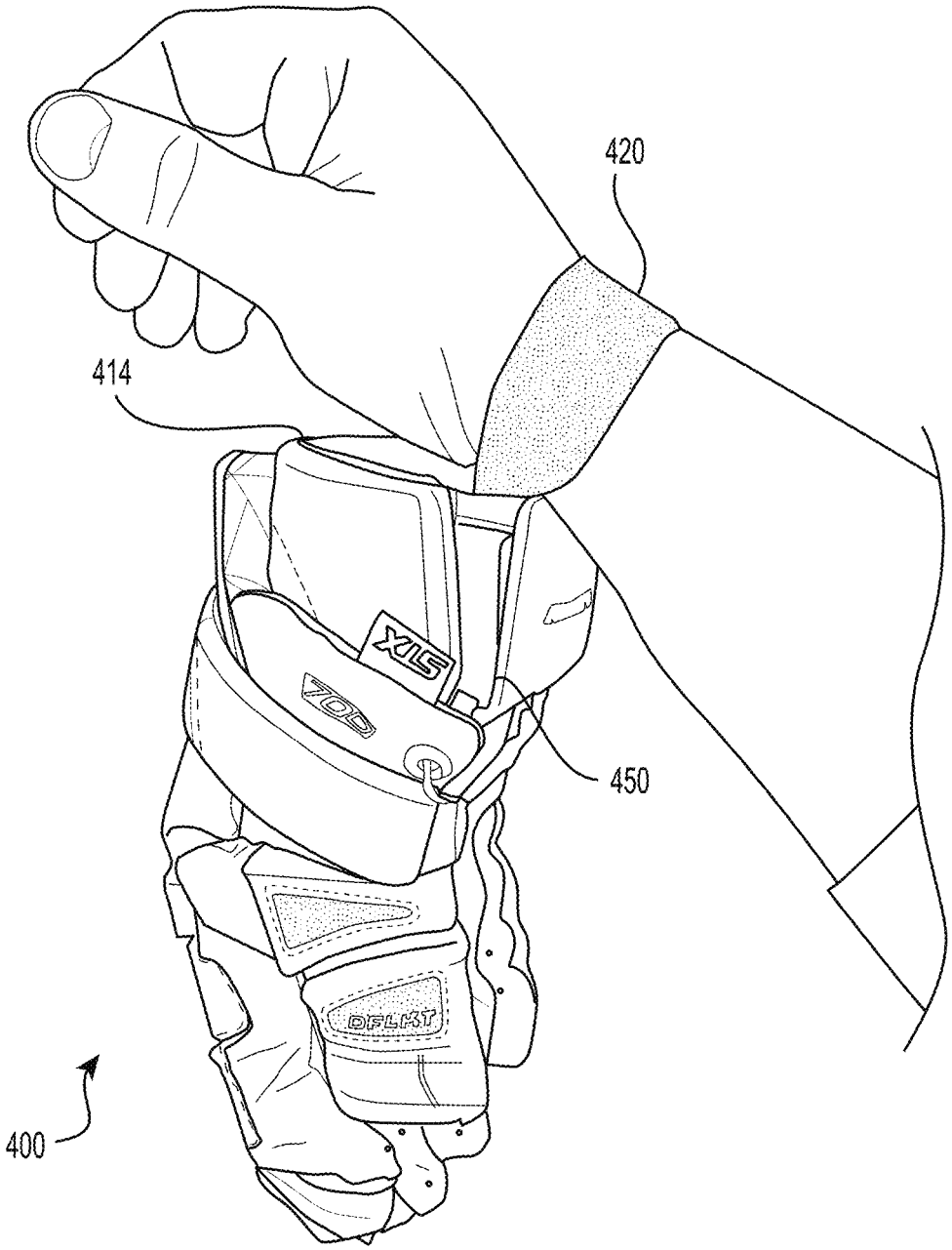
Figure 18:
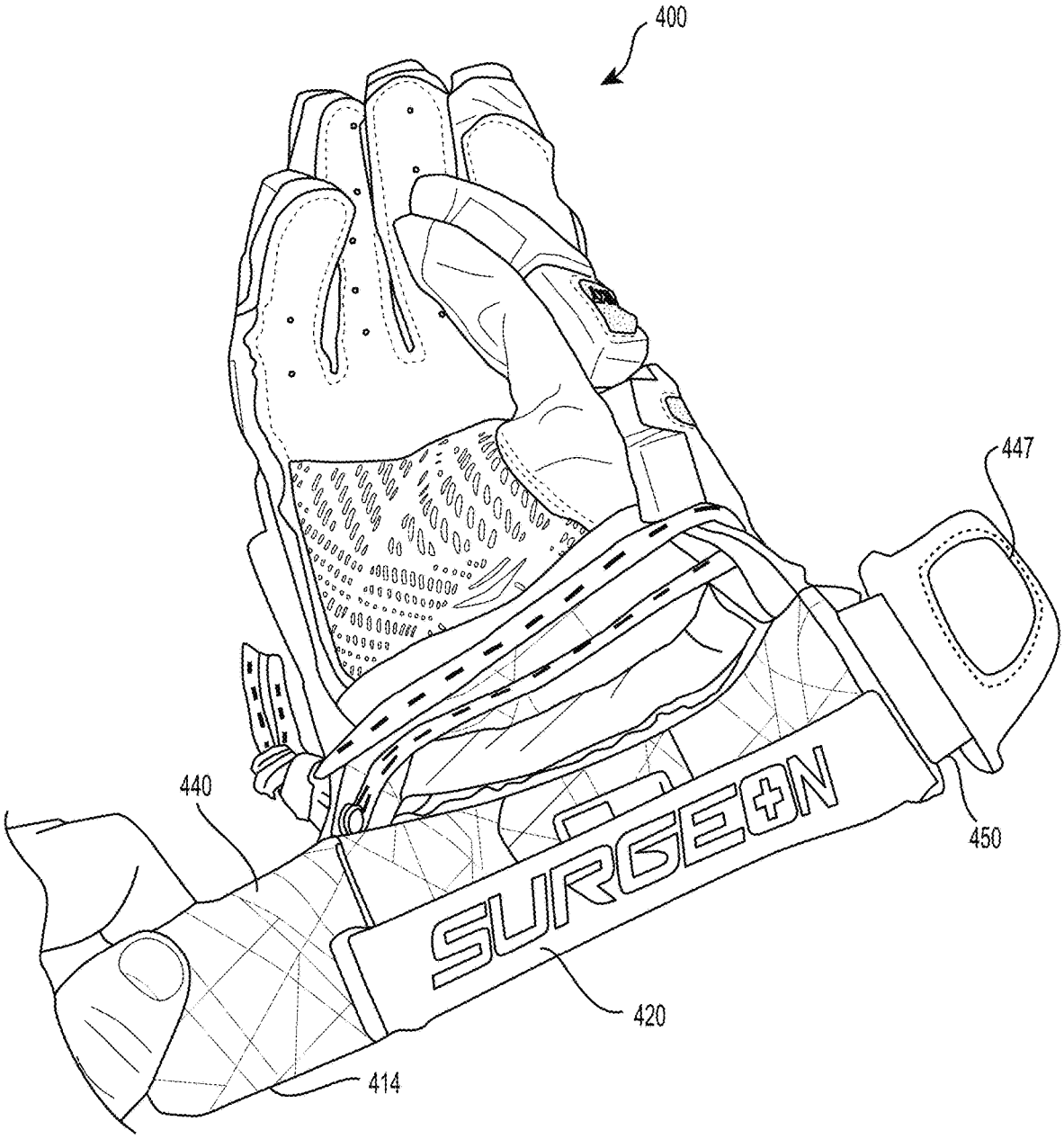
FIGS. 18 and 19 are images of another embodiment of a hand covering having a releasable and adjustable cuff portion with a retaining strap.
Figure 19:
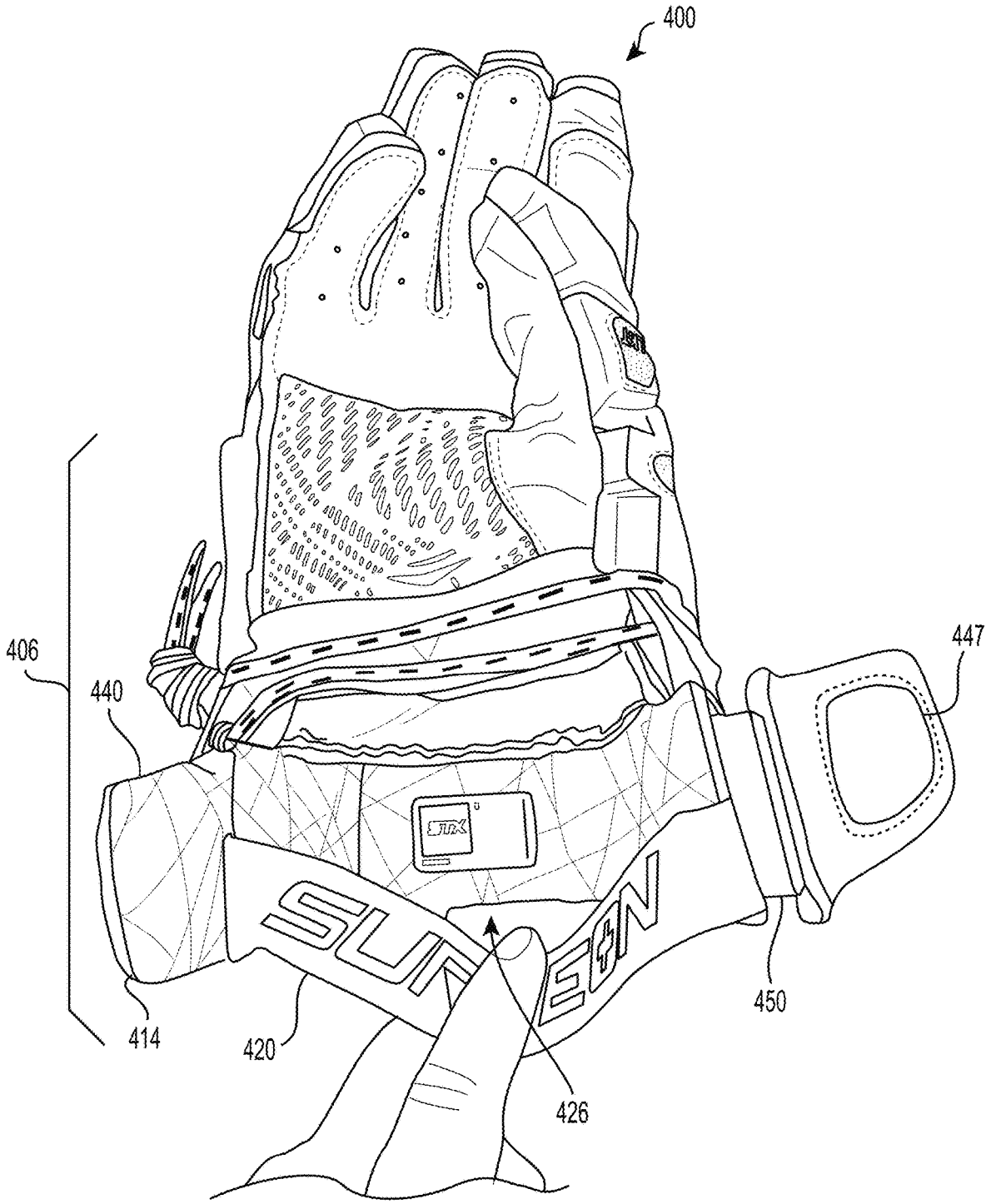

FIGS. 18 and 19 illustrate the inside of the glove 400 shown in FIGS. 15-17, according to an embodiment. As shown, the central hand portion 406 of glove 400 may include a releasable and adjustable cuff portion 414 having a cuff panel 440, a retaining strap 420, an elastic portion 450, and a releasable fastener 447. In this embodiment, retaining strap 420 is elastic and has a width approximately one-half the width of the cuff panel 440. FIG. 18 shows the retaining strap 420 in a nestled, relaxed state, while FIG. 19 shows the retaining strap 420 pulled away from the cuff panel 440 in a flexed, retaining configuration, showing the passageway 426 between the retaining strap 420 and the inside face of the cuff panel 440.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or hand covering.

It should also be noted that relative terms such as "over," "underneath," "side," "top," and "bottom," are used herein to describe the embodiments as depicted in the accompanying figures and are not intended to be limiting.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A hand covering comprising:

a central hand portion;

a finger receiving portion extending from the central hand portion;

wherein the hand covering extends generally in a longitudinal direction from a proximal side at the central hand portion to a distal side at the finger receiving portion, and wherein the central hand portion defines at the proximal side a cavity configured to receive a hand; and a strap attached to an inside face of the central hand portion and extending generally lateral to the longitudinal direction, wherein a proximal edge of the strap is disposed adjacent to a proximal edge of the proximal side of the hand covering within a distance less than a width of the strap, wherein the strap has a first end and a second end opposite to the first end, wherein the first end is directly attached to a first attachment point on the inside face and the second end is directly attached to a second attachment point on the inside face, and wherein the strap is separable from the inside face in between the first end and the second end to define a passageway configured for passage of the hand when withdrawn from the central hand portion.

2. The hand covering of claim 1, wherein the strap is elastic.

3. The hand covering of claim 1, wherein, when the strap is in a relaxed state, an arc length between the first end and the second end of the strap is substantially equal to an arc length between the first attachment point on the inside face and the second attachment point on the inside face.

4. The hand covering of claim 1, wherein the passageway is defined at a dorsal side of the hand covering.

5. The hand covering of claim 1, wherein the proximal edge of the strap is disposed at the proximal edge of the proximal side of the hand covering.

6. The hand covering of claim 1, wherein the central hand portion includes a cuff portion at the proximal side of the hand covering, wherein the cuff portion has an inside face configured to face the hand, a wrist, and/or a forearm of a user wearing the hand covering, and wherein the strap is attached to the inside face of the cuff portion.

7. The hand covering of claim 6, wherein the cuff portion comprises a cuff panel having a first end and a second end opposite to the first end of the cuff panel, wherein the cuff panel defines the inside face of the cuff portion, wherein the cuff panel extends from the first end of the cuff panel to the second end of the cuff panel in a direction generally lateral to the longitudinal direction and is configured to wrap around the hand, the wrist, and/or the forearm of the user wearing the hand covering with the first end of the cuff panel and the second end of the cuff panel disposed on a palmar side of the hand, the wrist, and/or the forearm of the user wearing the hand covering, wherein the first end of the cuff panel includes a first fastener portion and the second end includes a second fastener portion, and wherein the first fastener portion is configured to fasten to the second fastener portion to hold the cuff portion around the wrist of the user wearing the hand covering.

8. The hand covering of claim 7, wherein the cuff panel includes an elastic portion having a distal side, a proximal side, a first longitudinal side, and a second longitudinal side, wherein the first longitudinal side is attached to the first end of the cuff panel and the second longitudinal side is attached to the first fastener portion, such that the elastic portion allows the cuff panel to increase and decrease in length around the hand, the wrist, and/or the forearm of the user wearing the hand covering.

9. The hand covering of claim 7, wherein the first fastener portion and the second fastener portion comprise a hook and loop fastener.

10. The hand covering of claim 7, wherein, when the hand covering is worn by the user with the hand of the user in the cavity, the strap is configured to remain adjacent to the inside face of the cuff portion between the inside face of the cuff portion and the hand, the wrist, and/or the forearm of the user.

11. The hand covering of claim 7, wherein, when the hand covering is in a retaining configuration with the hand of the user out of the cavity, the strap is configured to hold the hand, the wrist, and/or the forearm of the user between the strap and the inside face of the cuff portion.

12. The hand covering of claim 7, wherein the strap's width is equal to or greater than one-quarter a width of the cuff panel.

13. The hand covering of claim 7, wherein the strap's width is greater than three-quarters a width of the cuff panel.

14. The hand covering of claim 1, wherein the hand covering is one of a glove or a mitten.

15. A hand covering comprising:

a proximal end and a distal end, wherein the hand covering extends generally in a longitudinal direction from the proximal end to the distal end;

a dorsal portion;

a palmar portion, wherein the dorsal portion and the palmar portion define a cavity configured to receive a central portion of a hand of a user, wherein the dorsal portion and/or the palmar portion define an opening at the proximal end, the opening configured to receive passage of the hand, wherein the dorsal portion and/or the palmar portion define a cuff panel at the proximal end, wherein the cuff panel forms an inside face facing the cavity; and a strap attached to the inside face of the cuff panel and extending generally lateral to the longitudinal direction from a first attachment point to a second attachment point, wherein the strap has a width at least one-quarter a width of the cuff panel, wherein the strap is separable from the inside face in between the first attachment point and the second attachment point, so as to define a passageway between the inside face and the strap, through which the hand may pass when exiting the cavity, wherein the strap is elastic, wherein the strap has a first end directly attached at the first attachment point and a second end directly attached at the second attachment point, and wherein, with the strap in a relaxed state absent application of a pulling force to the strap, an arc length of the strap from the first end to the second end is substantially equal to an arc length of the inside face from the first attachment point to the second attachment point, so that when the hand covering is fastened on the user, with the strap in the relaxed state, the strap remains substantially against the inside face, with the strap disposed between the user and the inside face.

16. The hand covering of claim 15, wherein a proximal edge of the strap is disposed adjacent to a proximal edge of the proximal end of the hand covering within a distance less than the width of the strap.

17. A method for using a hand covering, comprising:

receiving a hand of a user inside the hand covering, wherein the hand covering includes:

a central hand portion;

a finger receiving portion extending from the central hand portion;

wherein the hand covering extends generally in a longitudinal direction from a proximal side at the central hand portion to a distal side at the finger receiving portion, and wherein the central hand portion defines at the proximal side a cavity configured to receive the hand; and a strap attached to an inside face of the central hand portion and extending generally lateral to the longitudinal direction, wherein a proximal edge of the strap is disposed adjacent to a proximal edge of the proximal side of the hand covering within a distance less than a width of the strap, wherein the strap has a first end and a second end opposite to the first end, wherein the first end is directly attached to a first attachment point on the inside face and the second end is directly attached to a second attachment point on the inside face, and wherein the strap is separable from the inside face in between the first end and the second end to define a passageway configured for passage of the hand when withdrawn from the central hand portion, and wherein the strap is disposed between the user and the inside face of the central hand portion;

allowing the user to withdraw the hand from the cavity while passing the hand through the passageway between the strap and the inside face of the central hand portion; and allowing the user to pull the strap over a largest dimension of the hand to a position at approximately a wrist of the user, with the hand outside of the hand covering, and the remaining portions of the hand covering on a side of the wrist opposite to the strap.

18. The method of claim 17, wherein the central hand portion includes a releasable cuff portion at the proximal side of the hand covering, wherein the strap is attached to an inside face of the cuff portion, wherein the cuff portion includes an elastic portion, and wherein the method further comprises:

allowing the user to fasten the cuff portion around the wrist after placing the hand inside the hand covering and before withdrawing the hand; and allowing the user to, while withdrawing the hand and keeping the cuff portion fastened, pull the cuff portion to expand the elastic portion and increase the size of the cuff portion, to allow the hand to withdraw through the cuff portion and through the passageway.

* * * * *